US005409252A

United States Patent [19]

Pieber

[11] Patent Number: 5,409,252

[45] Date of Patent: Apr. 25, 1995

[54] RUNNING SURFACE FOR A SKI

[75] Inventor: Alois Pieber, Ried im Innkreis, Austria

[73] Assignee: Fischer Gesellschaft m.b.H., Ried im Inkreis, Austria

[21] Appl. No.: 128,146

[22] Filed: Sep. 29, 1993

[30] Foreign Application Priority Data

Oct. 8, 1992 [AU] Australia ..... 1986/92

[51] Int. Cl.[6] ..... A63C 7/06

[52] U.S. Cl. ..... 280/604

[58] Field of Search ..... 280/601, 604, 609

[56] References Cited

U.S. PATENT DOCUMENTS

| | | | |
|---|---|---|---|
| 3,408,086 | 10/1968 | Bennett | 280/604 |
| 4,268,059 | 5/1981 | Staufer | 280/604 |
| 4,323,265 | 4/1982 | Benner | 280/604 |
| 4,919,447 | 4/1990 | Jackson et al. | 280/604 |

FOREIGN PATENT DOCUMENTS

| | | | |
|---|---|---|---|
| 360884 | 6/1980 | Austria . | |
| 808359 | 2/1937 | France . | |
| 684155 | 11/1939 | Germany . | |
| 2142271 | 3/1973 | Germany . | |
| 3045853 | 6/1982 | Germany . | |
| 260224 | 9/1988 | Germany | 280/604 |

*Primary Examiner*—Margaret A. Focarino
*Assistant Examiner*—Michael Mar
*Attorney, Agent, or Firm*—Jacobson, Price, Holman & Stern

[57] ABSTRACT

A running surface for a ski, in particular a cross-country ski, in which at least in partial regions of the length and width of the ski a plurality of running surface indentations in the form of ramps successively stepped in the longitudinal direction of the ski are provided which in longitudinal section comprise a sawtooth-like profile which inhibits backward sliding. In the region of the stepped ramp (3) which has a shallow rise in the longitudinal direction of the ski, a secondary step is provided, the kick-off edge (6) of the secondary step (5) being positioned at a lower level than the kick-off edge (4) of the stepped ramp (3).

4 Claims, 2 Drawing Sheets

RUNNING SURFACE FOR A SKI

BACKGROUND OF THE INVENTION AND PRIOR ART

The invention relates to a running surface for a ski, in particular a cross-country ski, in which at least in partial regions of the length and width of the ski a plurality of running surface indentations in the form of ramps successively stepped in the longitudinal direction of the ski are provided which in longitudinal section comprise a sawtooth-like profile which inhibits backward sliding.

Such step-wise ramps serve for attaining a sliding kick-off effect.

A running surface of this type has become known from DE-PS 684.155. It includes in each longitudinal half at a certain distance from its external edge, at least one row of recesses in the form of successively arranged arrows the forwardly directed points of which lie on a common longitudinally extending line of symmetry of the ski which divides each recess into two symmetrical halves, in which the depression commences at the base of the arrow and increases towards the point of the arrow.

From AT-PS 360 884 a running surface has become known, in which across the width of the ski transversely to the longitudinal axis of the ski in each case a plurality of step-wise ramps with a central distance therebetween are arranged in a row and two transverse rows which in the longitudinal direction of the ski succeed each other with a space therebetween are mutually, transversely staggered, preferably about the half centre line spacing therebetween. In the known step-wise ramps the surface of the depression formed by the step-wise ramp rises from the edge of the step progressively and continuously up to the upper side of the running surface.

GENERAL DESCRIPTION OF THE INVENTION

An object of the invention is the provision of measures by which the relationship between kick-off and sliding ability is improved under all snow conditions. This object is attained by a running surface of the type referred to in the introduction in that according to the invention in that region of the stepped ramp which has a shallow rise in the longitudinal direction of the ski a secondary step is provided, the kick-off edge of the secondary step being positioned at a lower level than the kick-off edge of the stepped ramp.

The subject of the invention will be further explained with reference to the drawing.

BRIEF DESCRIPTION OF THE DRAWINGS

There is shown in.

Figure 3:
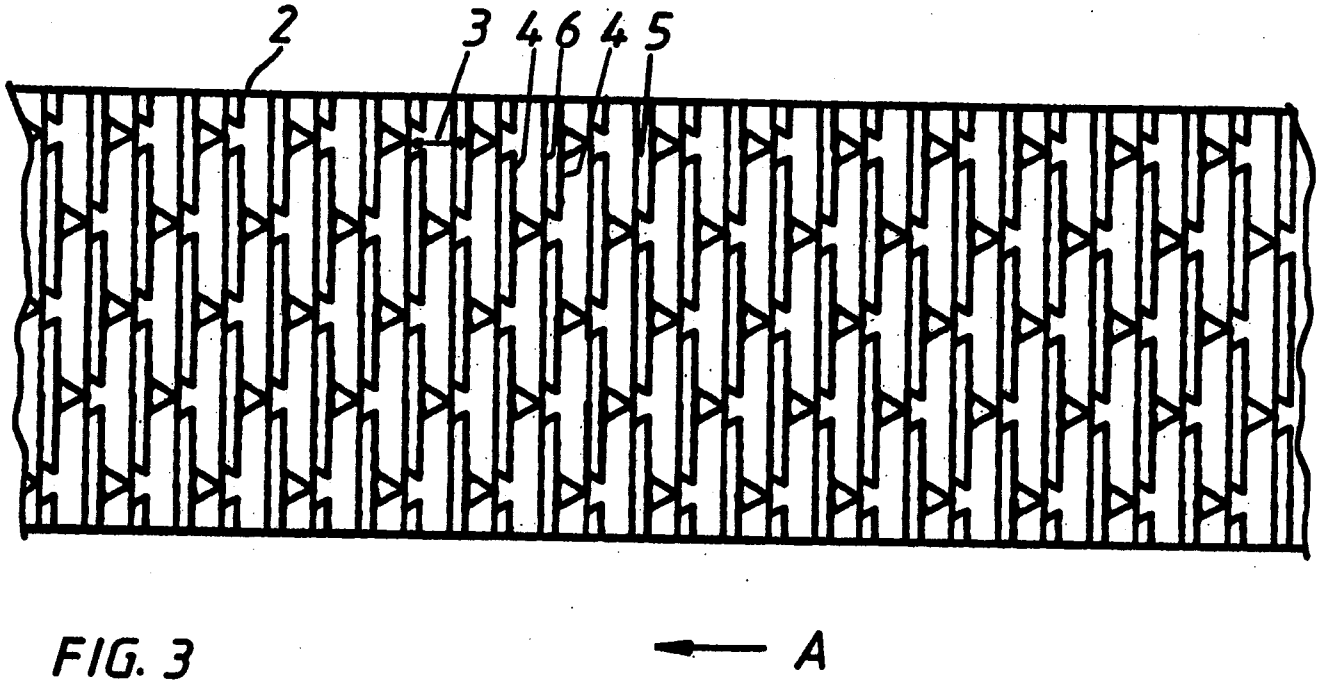

DESCRIPTION OF SPECIFIC EMBODIMENTS 1 denotes a ski respectively a running surface coating which comprises a running surface 2 in which sawtooth-like stepped ramps 3 are provided extending at a right-angle to the longitudinal axis of the ski and forming indentations which extend from a kick-off edge 4 at which the indentations are deepest and rising from there to the running surface 2. The configuration of the profiling can be selected optionally. Thus it is possible to design the step edge 4 rectilinearly as is shown for example in AT-PS 360 884 or curved as is shown for example by FR-PS 808 359. The individual stepped ramps 3 may extend merely over part of the width of the sliding surface, a plurality of stepped ramps, optionally with an intermediate spacing being arranged in a row next to one another. However, it is also possible to provide a single indentation only extending essentially over the entire width of the ski as is shown for example in DE-OS 21 42 271. Where a plurality of stepped ramps in a row are provided it is possible for individual transverse rows or the successive transverse rows to be in mutually staggered relationship in the transverse direction to the running direction, e.g. by half the centre spacing as is provided for, for example in the modification illustrated in FIG. 3.

Figure 1:
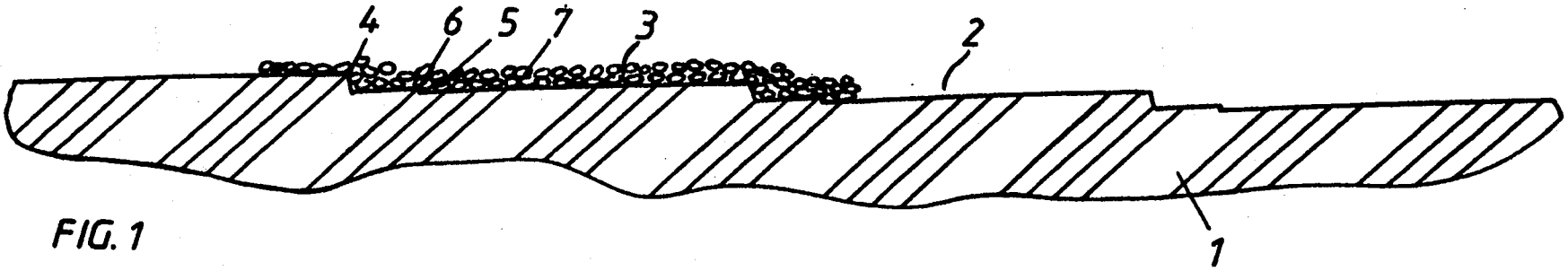
FIG. 1 the snow conditions in the kick-off phase of the ski
Figure 2:
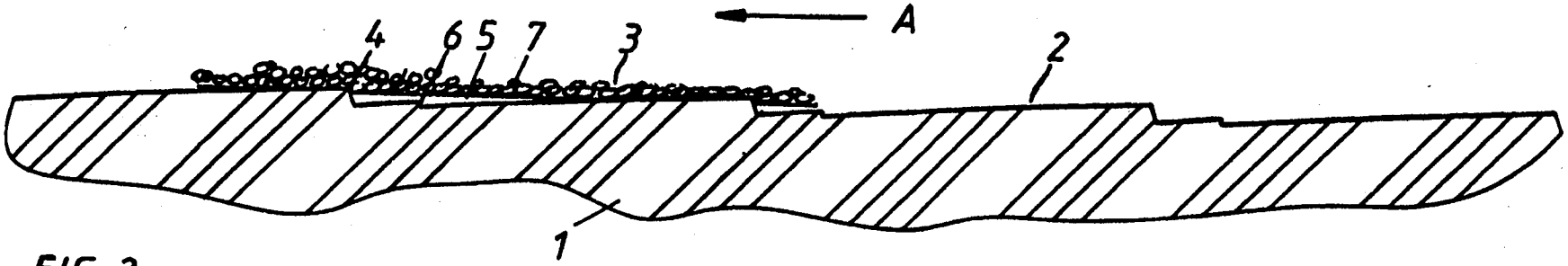
FIG. 2 in the sliding phase, in each case a longitudinal section of part of the running surface being illustrated, and FIG. 3 a plan view onto a working example of a running surface. In that case the running surface of the ski in the drawings always is upwardly directed, where the snow covering is indicated.

According to the invention all or only some stepped ramps 3 comprise a secondary step 5 including its own kick-off edge 6, which in the present case is lower down than the kick-off edge 4 of the stepped ramp 3. Due to the double step according to the invention, as may be seen from FIG. 1, an increased snow surface compression is attained during the kick-off phase in which the secondary step 5 can penetrate into the snow and thereby contribute to increasing the kick-off resistance respectively the surface grip. In the sliding phase the lower lying secondary step does not contact the snow so that during sliding the sliding friction is not increased. The arrow A denotes the direction of movement of the ski. In this context the snow crystals are denoted as 7.

Within the scope of the invention the stepped ramps may be machined into the sliding surface of a ski. However, it is also possible to provide the stepped ramps according to the invention in a running surface coating and to apply such running surface to any suitable ski.

In this specification and in the claims the expressions "upper" and "lower" refer to the ski positioned with its running surface directed upwardly.

The priority document is incorporated in this disclosure by cross-reference

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. A running surface for a ski, in which at least in partial regions of the length and width of the ski a plurality of running surface indentations in the form of first ramps successively stepped in the longitudinal direction of the ski are provided which in longitudinal section comprise a sawtooth-like profile which inhibits backward sliding, each of said first ramps having a first forward end and a second rearward end, said first forward end being located nearer to a horizontal central plane of the ski than the second rearward end which together with an immediately adjacent, steeply inclined side leading to the first forward end of an adjacent first ramp defines first kick-off edges, each of said first ramps having a shallow descent from the forward end to the rearward end and said first inclined ramps being provided with a secondary step adjacent the forward end, said secondary step consisting of a secondary inclined ramp with a secondary kick-off edge at a rearward end thereof, said secondary kick-off edge being located nearer to the said central plane of the ski than the immediately adjacent first kick-off edge of the first ramp.

2. A running surface as claimed in claim 1, wherein the ski is a cross-country ski.

3. A ski comprising a running surface as claimed in claim 1.

4. A ski as claimed in claim 1 which is a cross-country ski.

* * * * *